US008262163B2

(12) United States Patent
Wu

(10) Patent No.: US 8,262,163 B2
(45) Date of Patent: Sep. 11, 2012

(54) UPHOLSTERED RECLINER CHAIR WITH AN ADJUSTABLE BACKREST PADDING

(76) Inventor: Chieh-Ming Wu, Taichung Hsien (TW)

( * ) Notice: Subject to any disclaimer, the term of this patent is extended or adjusted under 35 U.S.C. 154(b) by 267 days.

(21) Appl. No.: 12/709,230

(22) Filed: Feb. 19, 2010

(65) Prior Publication Data

US 2011/0127824 A1 Jun. 2, 2011

(51) Int. Cl.
*A47C 1/035* (2006.01)

(52) U.S. Cl. ..... 297/343; 297/83; 297/353; 297/354.13; 297/284.7

(58) Field of Classification Search ..... 297/83, 297/284.7, 320, 330, 343, 53, 354.13
See application file for complete search history.

(56) References Cited

U.S. PATENT DOCUMENTS 3,936,893 A * 2/1976 Anderson et al. ..... 5/86.1
4,655,471 A * 4/1987 Peek ..... 280/250.1
5,193,880 A * 3/1993 Keusch et al. ..... 297/353
5,549,357 A * 8/1996 Counts et al. ..... 297/354.13
5,634,688 A * 6/1997 Ellis ..... 297/358
5,673,967 A * 10/1997 Wempe ..... 297/68
5,790,997 A * 8/1998 Ruehl ..... 5/618
6,015,189 A * 1/2000 Broadhead et al. ..... 297/353
7,296,856 B2 * 11/2007 Rozaieski et al. ..... 297/354.12
7,419,216 B2 * 9/2008 Hunziker ..... 297/330

* cited by examiner

*Primary Examiner* — Peter R. Brown
(74) *Attorney, Agent, or Firm* — Dickstein Shapiro LLP

(57) ABSTRACT

An upholstered recliner chair includes a base, a seat unit disposed on the base, a backrest frame pivotably mounted on the base and hingedly mounted to the seat unit to be displaceable between upright and tilted positions, a sidewise fixed lever extending radially from the backrest frame to be movable with the backrest frame, a backrest padding disposed to be slidable relative to the backrest frame in a lengthwise direction, and a pulling unit coupled to the backrest padding, the backrest frame, the sidewise fixed lever, and the seat unit such that the backrest padding is moved with the sidewise fixed lever during displacement of the backrest frame between the upright and tilted position to thereby vary a distance between the backrest padding and the seat unit.

8 Claims, 6 Drawing Sheets

UPHOLSTERED RECLINER CHAIR WITH AN ADJUSTABLE BACKREST PADDING

BACKGROUND OF THE INVENTION

1. Field of the Invention

This invention relates to an upholstered recliner chair, more particularly to an upholstered recliner chair in which a distance between a backrest padding and a seat padding is adjustable.

2. Description of the Related Art

Referring to FIG. 1, a conventional upholstered recliner chair 1 is shown to include a seat 11 and a backrest 12 pivotably mounted on a rear side of the seat 11 so as to be inclined relative to the seat 11. A leather-like cover 13 has a first end 131 connected to the seat 11, and a second end 132 connected to the backrest 12. When the backrest 12 is displaced relative to the seat 11 to a tilted position (as indicated by dash lines in FIG. 1), the first and second ends 131,132 are displaced away from each other and the cover 13 can be tensed to provide comfort to a user lying on the chair 1.

However, since a clearance between the seat 11 and the backrest 12 is fixed, when the backrest 12 is displaced to an upright position (as indicated by solid lines in FIG. 1), due to a decrease in the distance between the first and second ends 131,132, the cover 13 will be in a saggy state and form a crease/fold, which will make the user uncomfortable.

SUMMARY OF THE INVENTION

An object of the present invention is to provide an upholstered recliner chair in which a distance between a backrest padding and a seat padding is adjustable to provide a comfortable feeling for a user sitting or lying thereon.

According to this invention, the upholstered recliner chair includes a base which has upwardly extending front and rear posts, a backrest frame which has neck-side and waist-side ends that are opposite to each other in a lengthwise direction, and which is pivotally mounted on an upper mount end of the rear post at a position proximate to the waist-side end to be angularly displaceable between upright and tilted positions about a fulcrum axis, and a seat frame which has a rear end hingedly mounted to the waist-side end of the backrest frame about a hinge axis such that the backrest frame is moved from the upright position to the tilted position when the liftable region is lifted from a lower position to an upper position, and a front end disposed to rest on an upper mount end of the front post. A sidewise fixed lever extends from the waist-side end of the backrest frame in a radial direction relative to the hinge axis to terminate at a distal end to be angularly movable about the hinge axis between non-actuating position and actuating positions that correspond to the tilted position and the upright position of the backrest frame, respectively. A backrest padding extends lengthwise to terminate at neck-side and waist-side edge portions, and is disposed to be slidable relative to the backrest frame between normal and extended positions, where the waist-side edge portion is closer to and remote from the hinge axis, respectively. A pulling unit is coupled to the backrest padding, the backrest frame, the sidewise fixed lever, and the seat frame such that, when the sidewise fixed lever is moved from the non-actuating position to the actuating position, the backrest padding is moved from the normal position to the extended position. A seat padding is mounted on the seat frame, and has front and rear edge portions that correspond to the front and rear ends, respectively. Since a distance between the seat and backrest paddings is variable with the movement of the seat frame that moves the backrest frame between the upright and tilted position, the recliner chair of this invention can provide a comfortable feeling when in use.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
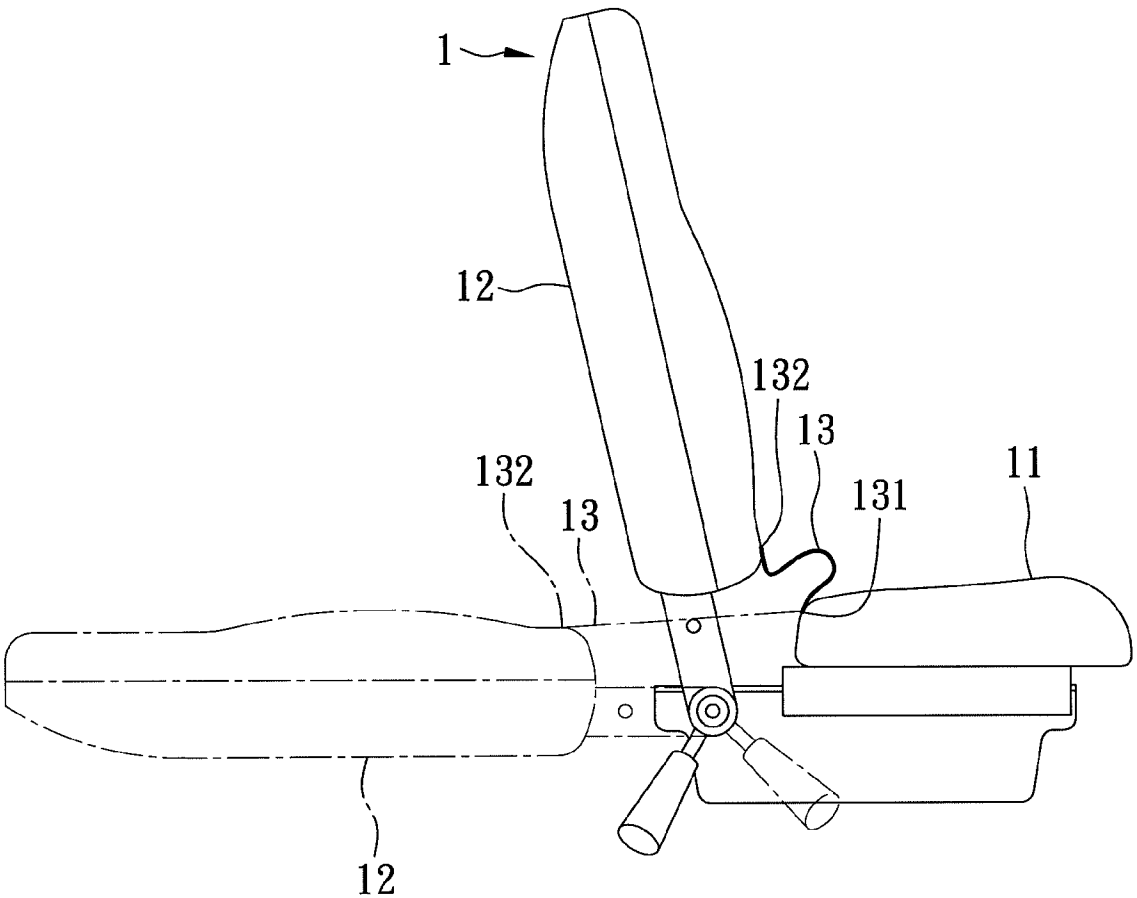
FIG. 1 PRIOR ART
FIG. 1 is a schematic view of a conventional upholstered recliner chair.
Figure 2:
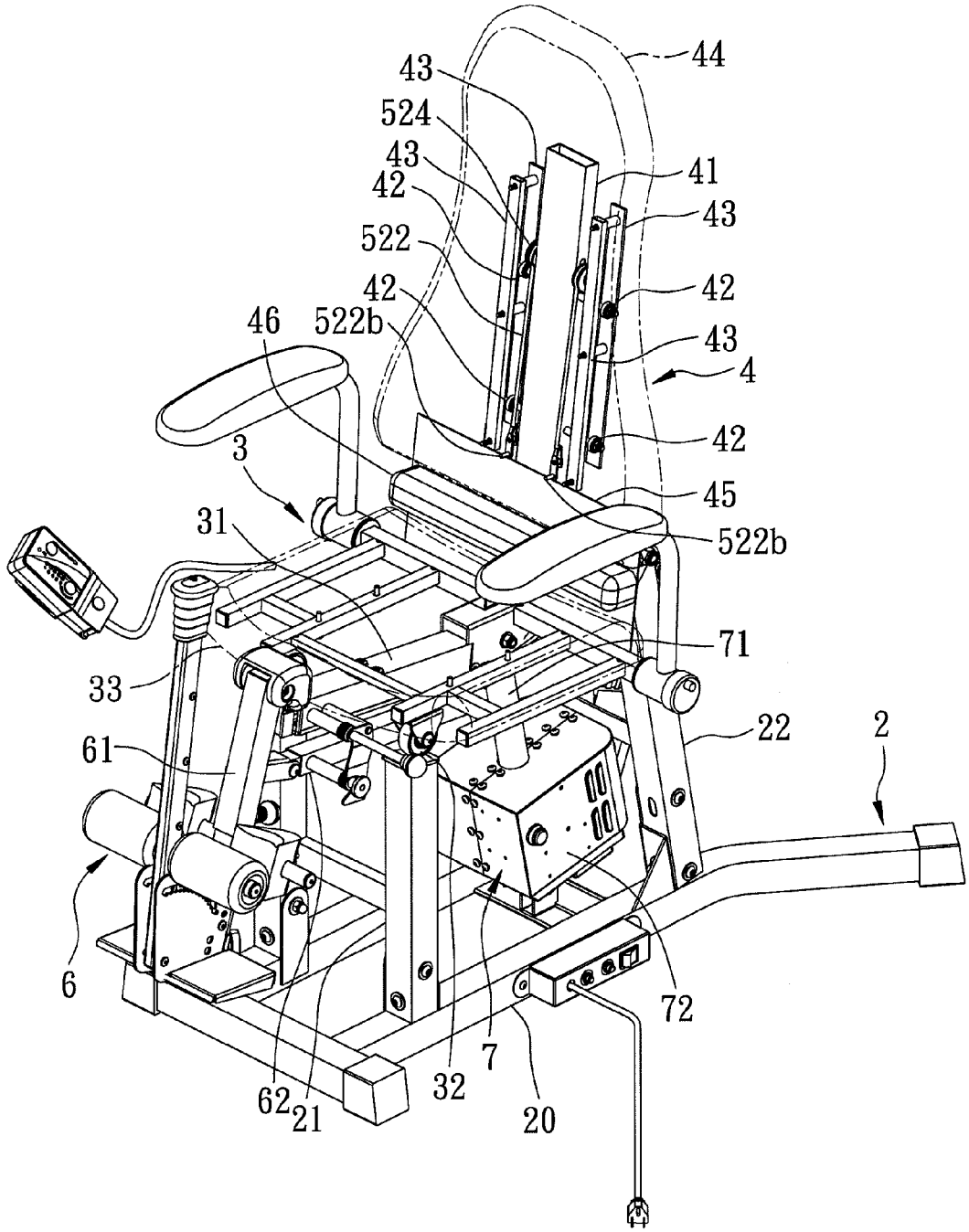
FIG. 2 is a perspective view of the preferred embodiment of an upholstered recliner chair according to this invention.
Figure 3:
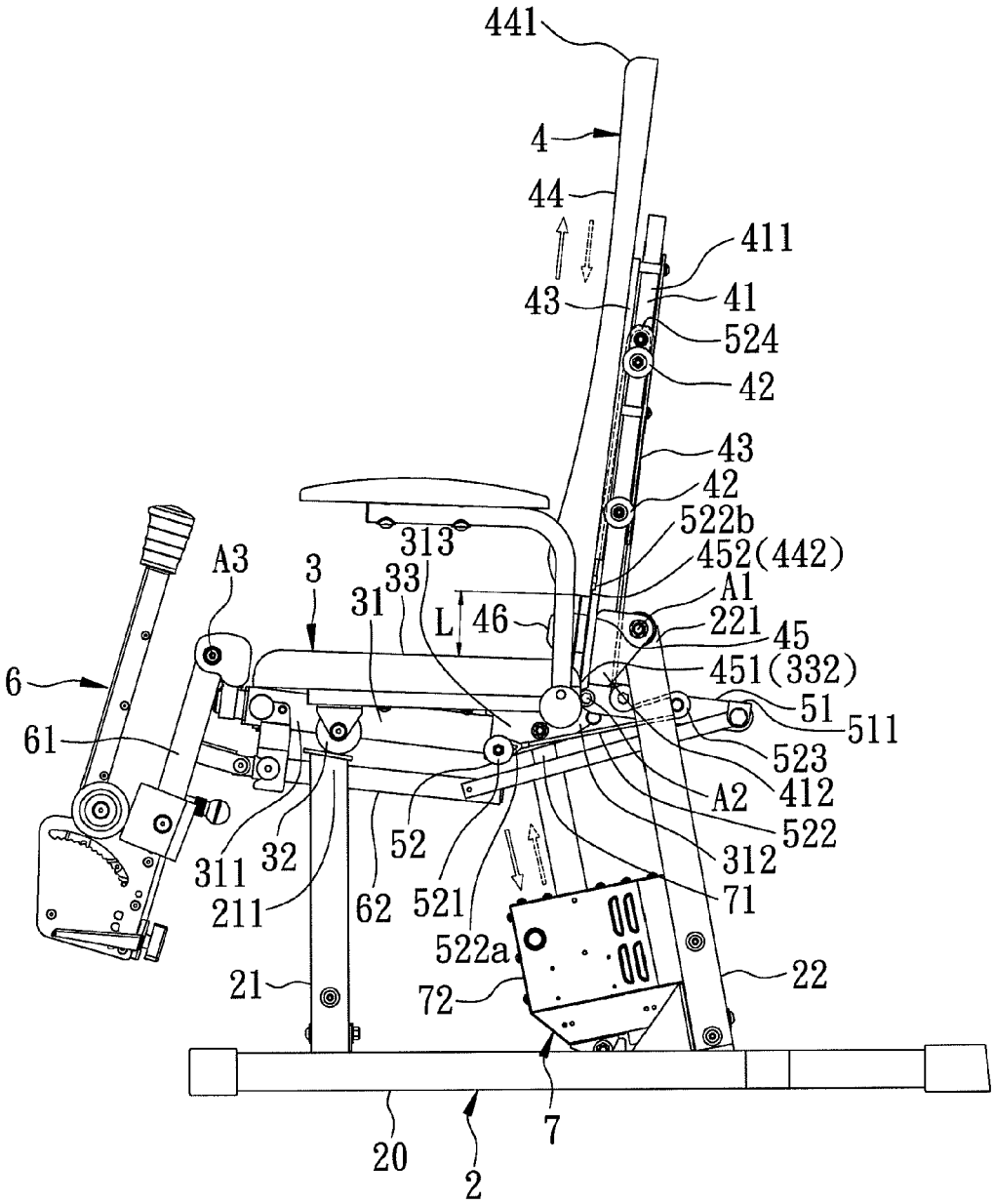
FIGS. 3 to 5 are schematic side views of the preferred embodiment showing how a seat frame is moved upwardly to bring a backrest frame to displace from an upright position to a tilted position.
Figure 4:
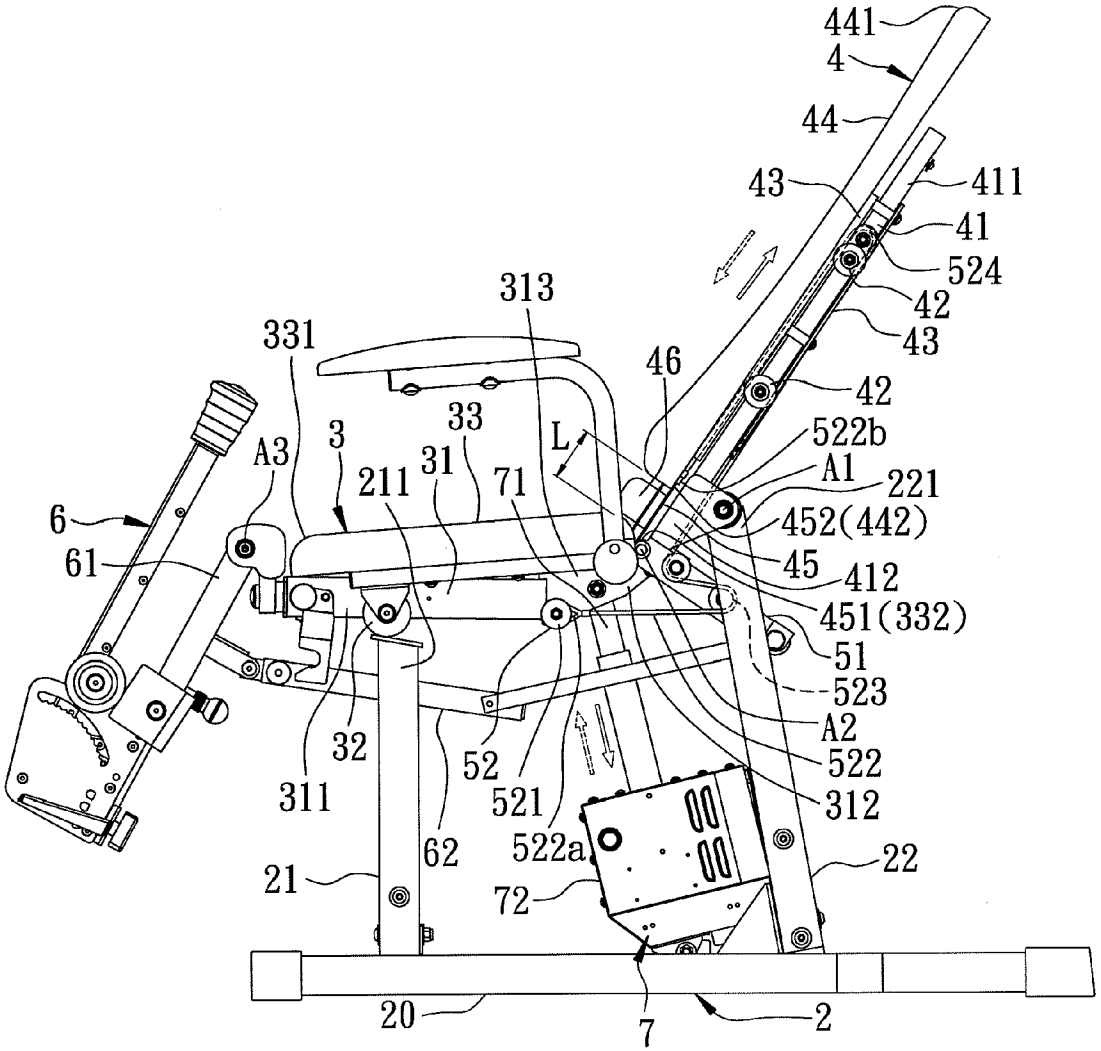

Referring to FIGS. 2 and 3, the preferred embodiment of an upholstered recliner chair according to the present invention is adapted to be used as a body exercising device, and is shown to comprise a base 2, a seat unit 3, a backrest unit 4, two sidewise fixed levers 51, two pulling units 52, a left lifting unit 6, and a lifting unit 7.

The base 2 includes a base body 20, two front posts 21, and two rear posts 22. Each of the front and rear posts 21,22 extends upwardly from the base body 20 to terminate at an upper mount end 211,221. The front posts 21 and the rear posts 22 are disposed opposite to each other in a longitudinal direction.

The seat unit 3 includes a seat frame 31 and a seat padding 33. The seat frame 31 has front and rear ends 311,312 opposite to each other in the longitudinal direction, and a liftable region 313 disposed adjacent to the rear end 312. Two casters 32 are pivotally mounted on the front end 311 of the seat frame 31 to rollably rest on the upper mount ends 211 of the front posts 21, respectively. The seat padding 33 is mounted securely on the seat frame 31, and has front and rear edge portions 331,332 that correspond to the front and rear ends 311,312, respectively.

The backrest unit 4 includes a backrest frame 41, a plurality of rollers 42, two slides 43, a backrest padding 44, a flexible web segment 45, and a waist padding 46. The backrest frame 41 has neck-side and waist-side ends 411,412 opposite to each other in a lengthwise direction thereof. The backrest frame 41 is pivotally mounted on the upper mount ends 221 of the rear posts 22 at a position proximate to the waist-side end 412 to be angularly displaceable between upright and tilted positions about a fulcrum axis (A1) that is transverse to the lengthwise and longitudinal directions. The waist-side end 412 is hingedly mounted to the rear end 312 about a hinge axis (A2) that is parallel to the fulcrum axis (A1). Thus, when the liftable region 313 is lifted from a lower position to an upper position, the backrest frame 41 is moved from the upright position to the tilted position. The rollers 42 are rollably mounted on the backrest frame 41. The slides 43 are slidably engaged with the rollers 42 to be slidable in the lengthwise direction relative to the backrest frame 41. The backrest padding 44 extends lengthwise to terminate at neck-side and waist-side edge portions 441,442, and is securely connected to the slides 43 so as to be slidable relative to the backrest frame 41 between normal and extended positions, where the waist-side edge portion 442 is closer to and remote from the hinge axis (A2), respectively. The flexible web segment 45 has a first end 451 connected to the rear edge portion 332 of the seat padding 33, and a second end 452 connected to the waist-side edge portion 442 of the backrest padding 44, and is dimensioned such that the flexible web segment 45 is stretched to be placed in a non-saggy state when the backrest frame 41 is in the tilted position. The waist padding 46 is formed on the flexible web segment 45.

Each of the sidewise fixed levers 51 extends from the waist-side end 412 of the backrest frame 41 in a radial direction relative to the hinge axis (A2) to terminate at a distal end 511 to be angularly movable about the hinge axis (A2) between non-actuating position and actuating positions that correspond to the tilted position and the upright position of the backrest frame 41, respectively.

Each of the pulling units 52 includes a plurality of pulleys 521,523,524 which are rollably mounted on the seat frame 31, a respective one of the sidewise fixed levers 51, and the backrest frame 41, respectively, and a pulling cord 522. The pulley 523 disposed on the sidewise fixed lever 51 between the hinge axis (A2) and the distal end 511 serves as a force transmitting member. The pulley 524 disposed on the neck-side end 411 of the backrest frame 41 serves as a direction reversing member. The pulling cord 522 has an engaging end (522*b*) secured to and movable with the waist-side edge portion 442 of the backrest padding 44, and a cord segment extending from the engaging end (522*b*). The cord segment is led toward the neck-side end 411 of the backrest frame 41, is wound on the pulley 524 to be in slidable engagement with the pulley 523, and terminates at a coupling end (522*a*) which is coupled to the seat frame 31.

The leg lifting unit 6 includes a leg lifting frame 61 which is pivotally mounted on the front end 311 of the seat frame 31 about a pivot axis (A3), and a linkage 62 which is pivotally connected to the leg lifting frame 61 and the distal. ends 511 of the sidewise fixed levers 51. Thus, when the sidewise fixed levers 51 are moved from the non-actuating non-actuating position to the actuating position, the leg lifting frame 61 is pivotally moved from a lifting position to a hanging-down position.

The lifting unit 7 has a lifting shaft 71 which is coupled to the liftable region 313 of the seat frame 31 to drive movement of the seat frame 31 between the upper and lower positions, and a driver 72, such as a motor.

Figure 5:
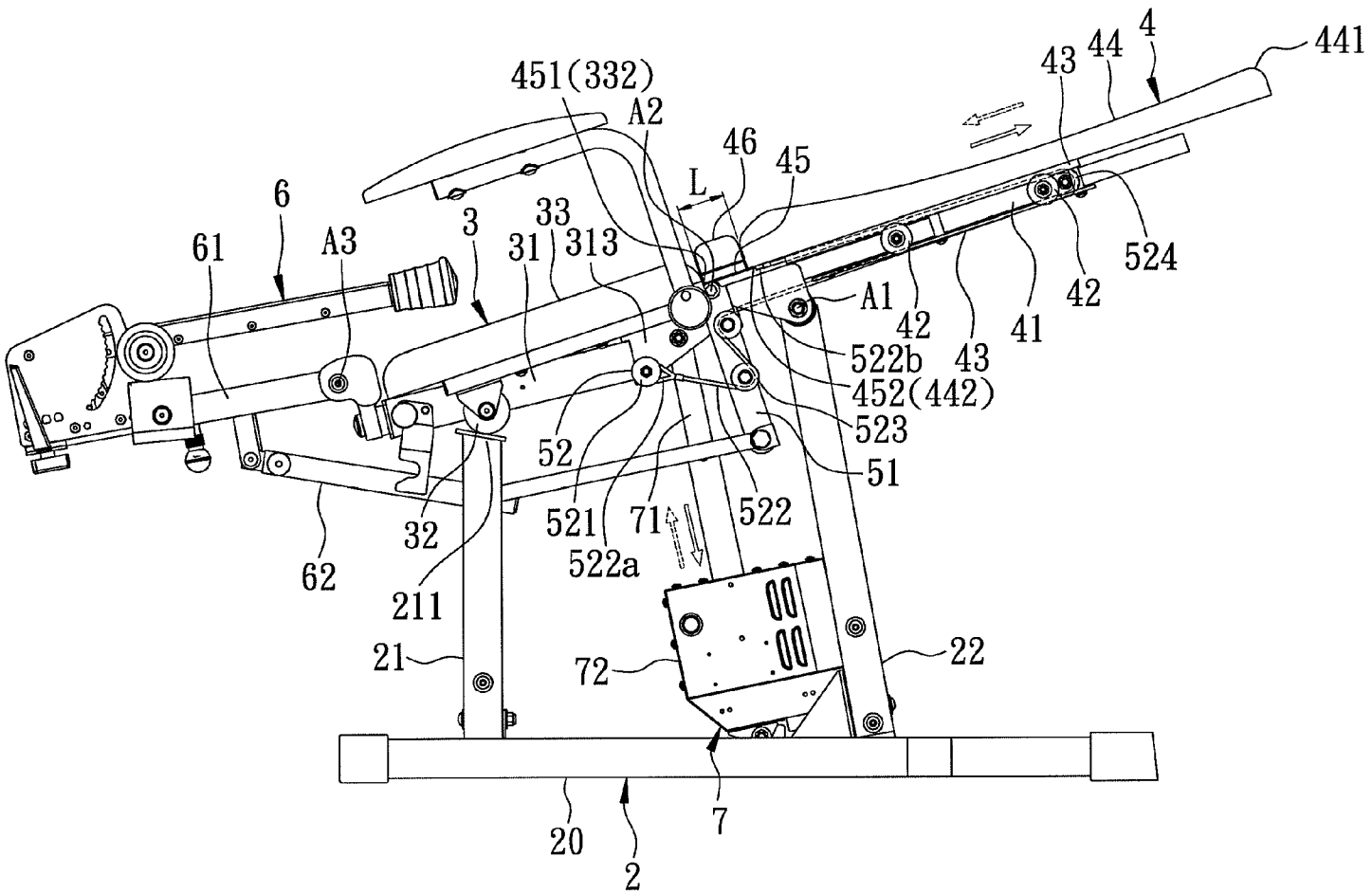

When the lifting shaft 71 is actuated by the driver 72 to move gradually and downwardly in a direction indicated by a solid-line arrow from a state as shown in FIG. 5, to a state as shown in FIG. 3, the liftable region 313 of the seat frame 31 is pivotally moved about fulcrums at the casters 32 on the upper mount ends 211 of the front posts 21, and the sidewise fixed levers 51 are angularly moved from the non-actuating position to the actuating position in a counterclockwise direction about the hinge axis (A2). At this point, the backrest frame 41 is angularly displaced about the fulcrum axis (A1) from the tilted position to the upright position. As a result of the angular displacement of the sidewise fixed levers 51, the length of the pulling cord 522 of each of the pulling units 52 between the coupling end (522*a*) and the respective pulley 523 is increased so that the engaging end (522*b*) can tow the backrest padding 44 from the normal position to the extended position to thereby enlarge a distance (L) between the rear edge portion 332 of the seat padding 33 and the waist-side edge portion 442 of the backrest padding 44. Thus, the flexible web segment 45 can be kept in the non-saggy state, and the waist padding 46 can be steadily and smoothly disposed between the backrest padding 44 and the seat padding 33. Moreover, during angular displacement of the sidewise fixed levers 51, the leg lifting frame 61 is moved by means of the linkage 62 to the hanging-down position.

When the lifting shaft 71 is actuated to move upwardly in a direction indicated by a dotted-line arrow from a state as shown in FIG. 3 to a state as shown in FIG. 5, the liftable region 313 of the seat frame 31 is pivotally lifted to turn the sidewise fixed levers 51 in a clockwise direction to the non-actuating position, and the backrest frame 41 is turned to the tilted position. As a result of turning of the sidewise fixed levers 51, the length of the pulling cord 522 of each of the pulling units 52 between the coupling end (522*a*) and the respective pulley 523 is decreased to thereby permit movement of the backrest padding 44 and the slides 43 to the normal position by virtue of gravity. At this point, the leg lifting frame 61 is turned to the lifting position.

Figure 6:
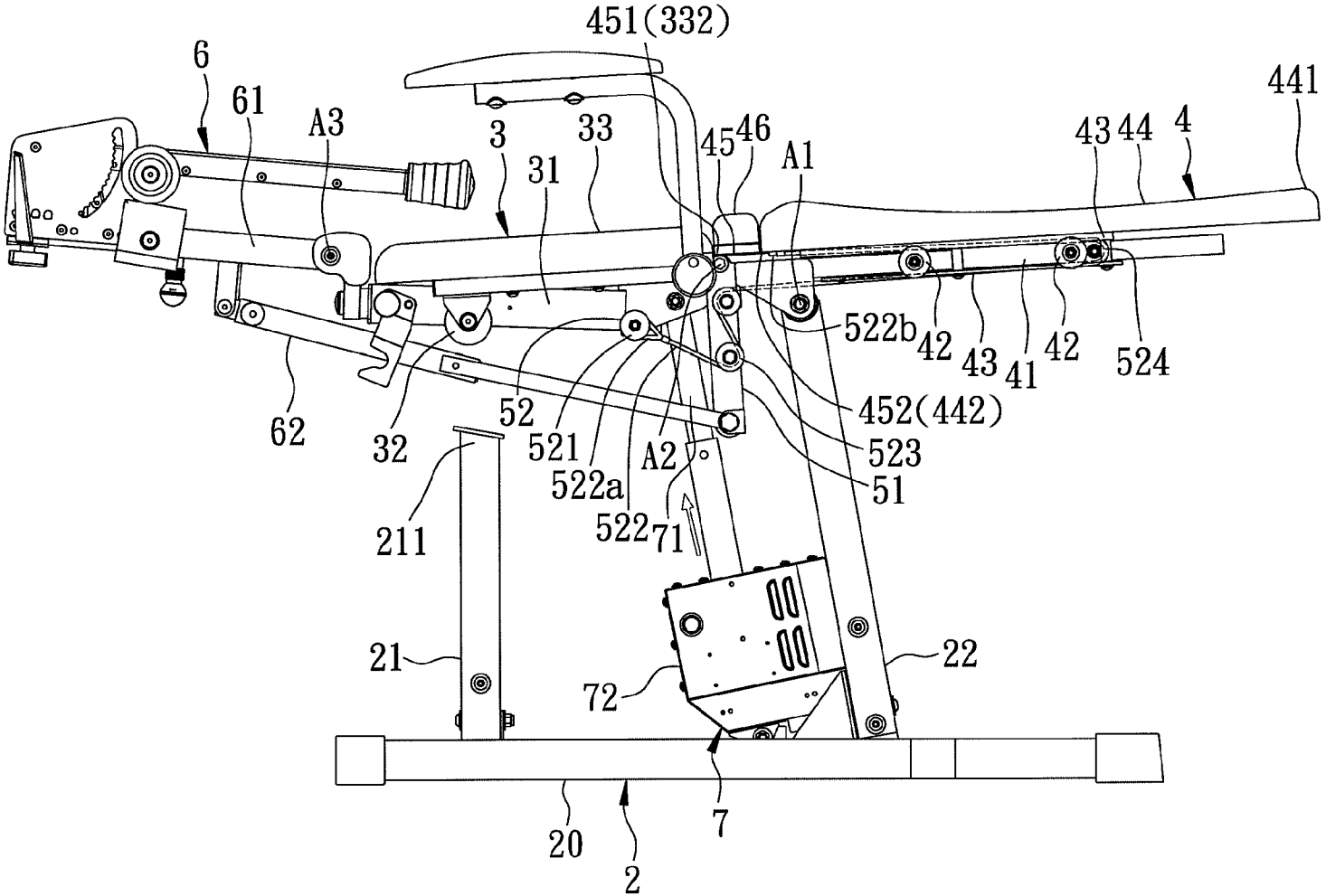
FIG. 6 is schematic side view of the preferred embodiment showing how the seat frame is moved further upwardly.

Referring to FIG. 6, when the lifting shaft 71 is further actuated to move the seat frame 31 upwardly, the entire assembly of the seat unit 3, the backrest unit 4 and the leg lifting unit 6 is turned in the clockwise direction about the fulcrum axis (A1). Thus, the casters 32 are separated from the upper mount ends 211 of the front posts 21 and are suspended in the air.

As illustrated, since the distance (L) between the seat and backrest paddings 33,44 is variable with the movement of the seat frame 31 that is driven by the lifting unit 7 to move the backrest frame 41 between the upright and tilted position, the flexible web segment 45 can be kept in the non-saggy state and the waist padding 46 can be smoothly and steadily disposed thereon so as to ensure user comfort.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An upholstered recliner chair comprising:

front and rear posts disposed opposite to each other in a longitudinal direction, each of said front and rear posts extending upwardly to terminate at an upper mount end;

a backrest frame which has neck-side and waist-side ends that are opposite to each other in a lengthwise direction, said backrest frame being pivotally mounted on said upper mount end of said rear post at a position proximate to said waist-side end, and being angularly displaceable between upright and tilted positions about a fulcrum axis transverse to the lengthwise and longitudinal directions;

a seat frame having front and rear ends which are opposite to each other in the longitudinal direction, and a liftable region disposed adjacent to said rear end, said rear end being hingedly mounted to said waist-side end of said backrest frame about a hinge axis that is parallel to the fulcrum axis such that, when said liftable region is lifted from a lower position to an upper position, said backrest frame is moved from the upright position to the tilted position, said front end being detachably supported on said upper mount end of said front post when said backrest frame is in the upright position;

a sidewise fixed lever which extends from said waist-side end of said backrest frame in a radial direction relative to the hinge axis to terminate at a distal end, and which is angularly movable about the hinge axis between non-actuating and actuating positions that correspond to the tilted position and the upright position of said backrest frame, respectively;

a backrest padding which extends lengthwise to terminate at neck-side and waist-side edge portions, and which is disposed to be slidable relative to said backrest frame between normal and extended positions, where said waist-side edge portion is closer to and remote from the hinge axis, respectively;

a pulling unit which is coupled to said backrest padding, said backrest frame, said sidewise fixed lever, and said seat frame such that, when said sidewise fixed lever is moved from the non-actuating position to the actuating position, said backrest padding is moved from the normal position to the extended position; and a seat padding which is mounted on said seat frame, and which has front and rear edge portions that correspond to said front and rear ends, respectively.

2. The upholstered recliner chair according to claim 1, further comprising a flexible web segment which interconnects said waist-side edge portion and said rear end, and which is dimensioned such that said flexible web segment is stretched to be thereby placed in a non-saggy state when said backrest frame is in the tilted position, and such that, when said backrest frame is displaced to the upright position, said flexible web segment is kept in the non-saggy state as a result of displacement of said backrest padding to the extended position.

3. The upholstered recliner chair according to claim 1, wherein said pulling unit includes a direction reversing member disposed on said backrest frame adjacent to said neck-side end;

a force transmitting member disposed on said sidewise fixed lever between the hinge axis and said distal end; and a pulling cord having an engaging end secured to and movable with said backrest padding, and a cord segment extending from said engaging end, said cord segment being led toward said neck-side end, being wound on said direction reversing member to be in slidable engagement with said force transmitting member, and terminating at a coupling end which is coupled to said seat frame.

4. The upholstered recliner chair according to claim 3, further comprising a plurality of rollers which are rollably mounted on said backrest frame; and a slide which is securely mounted on said backrest padding, and which is slidably engaged with said rollers to be slidable in the lengthwise direction relative to said backrest frame so as to facilitate movement of said backrest padding between the normal and extended positions.

5. The upholstered recliner chair according to claim 3, wherein each of said direction reversing member and said force transmitting member includes at least one pulley which is rotatably mounted on a respective one of said backrest frame and said sidewise fixed lever so as to permit said cord segment to be trained on said pulley.

6. The upholstered recliner chair according to claim 1, further comprising a lifting unit which is disposed to drive movement of said liftable region of said seat frame between the upper and lower positions.

7. The upholstered recliner chair according to claim 1, further comprising:

a leg lifting frame which is pivotally mounted on said front end of said seat frame; and a linkage which is pivotally connected to said leg lifting frame and said distal end of said sidewise fixed lever such that, when said sidewise fixed lever is moved from the non-actuating position to the actuating position, said leg lifting frame is pivotally moved from a lifting position to a hanging-down position.

8. The upholstered recliner chair according to claim 1, further comprising a caster which is pivotally mounted on said front end of said seat frame and which is disposed to rollably rest on said upper mount end of said front post when said backrest frame is in the upright position.

* * * * *